United States Patent [19]

Horton

[11] Patent Number: 4,702,321

[45] Date of Patent: Oct. 27, 1987

[54] DRILLING, PRODUCTION AND OIL STORAGE CAISSON FOR DEEP WATER

[76] Inventor: Edward E. Horton, 85 Vanderlip Dr., Portugese Bend, Calif. 90274

[21] Appl. No.: 778,496

[22] Filed: Sep. 20, 1985

[51] Int. Cl.[4] ..... B63B 35/44; E02D 5/74; E21B 7/12; E21B 43/01

[52] U.S. Cl. ..... 166/350; 114/256; 114/264; 166/354; 166/358; 175/8; 405/205; 405/210; 405/224

[58] Field of Search ..... 166/338, 339, 341, 344, 166/345, 350, 354, 355, 359, 367; 175/7, 8, 9; 405/205, 207, 210, 224, 227, 228; 114/256, 264

[56] References Cited

U.S. PATENT DOCUMENTS

| | | | |
|---|---|---|---|
| 3,360,810 | 1/1968 | Busking | 441/5 |
| 3,470,838 | 10/1969 | Daniell | 114/267 |
| 3,572,041 | 3/1971 | Graat | 405/205 |
| 3,760,875 | 9/1973 | Busking | 166/354 |
| 3,778,854 | 12/1973 | Chow | 441/4 |
| 3,889,476 | 6/1975 | Gerin | 405/210 |
| 3,903,705 | 9/1975 | Beck et al. | 405/224 |
| 3,921,557 | 11/1975 | Kapteijn et al. | 114/256 |
| 3,949,693 | 4/1976 | Baver et al. | 405/207 X |
| 4,098,333 | 7/1978 | Wells et al. | 175/7 X |
| 4,181,453 | 1/1980 | Vache | 405/205 X |
| 4,372,706 | 2/1983 | Young | 405/224 X |
| 4,423,982 | 1/1984 | Faremba | 166/338 X |
| 4,428,702 | 1/1984 | Abbott et al. | 405/227 X |
| 4,473,323 | 9/1984 | Gregory | 166/350 X |

*Primary Examiner*—Stephen J. Novosad

*Attorney, Agent, or Firm*—Poms, Smith, Lande & Rose

[57] ABSTRACT

A drilling, production and oil storage caisson for use in deep water offshore well operations in which the caisson has such a deep draft that its bottom end is subject only to minimal excitation forces caused by wave, wind and current acting on the caisson, the caisson including a plurality of oil storage compartments, a plurality of water ballast compartments above said oil storage compartments, a through axial passageway through said compartments; a riser system including a plurality of riser pipes in concentric circular arrangement within the through passageway or center well, each of the riser pipes being supported and tensioned by a buoyant flotation unit connected thereto; a drill string extending axially through said passageway between said riser pipes; and mooring lines connected to the bottom portion of the caisson extending therefrom with relatively low scope of 1:1 or less and providing a small watch circle for anchors for said mooring lines, the mooring lines being tensioned so that the mooring lines are substantially straight. A counterbalance for the drilling string includes a weighted section located near the bottom of the caisson. A deep draft caisson constructed and arranged so that heave motions are minimal.

21 Claims, 21 Drawing Figures

Fig. 14.
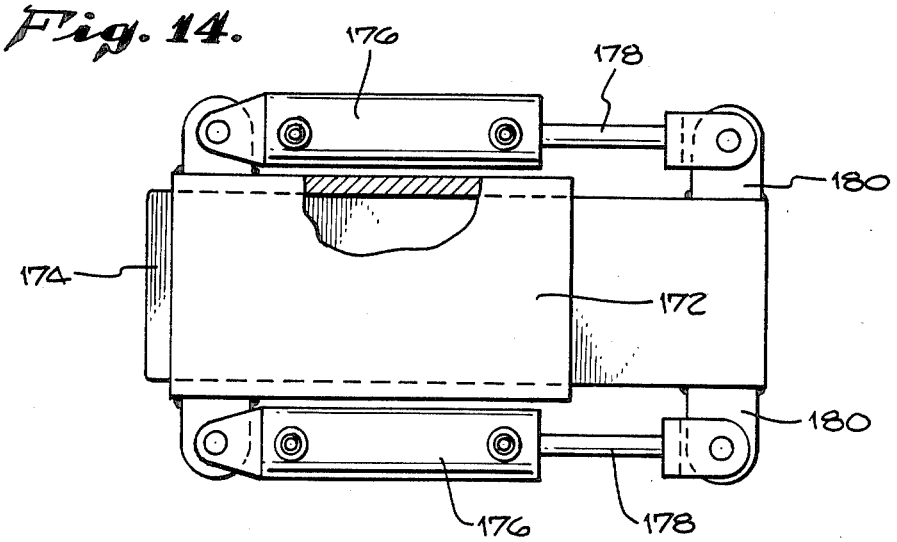
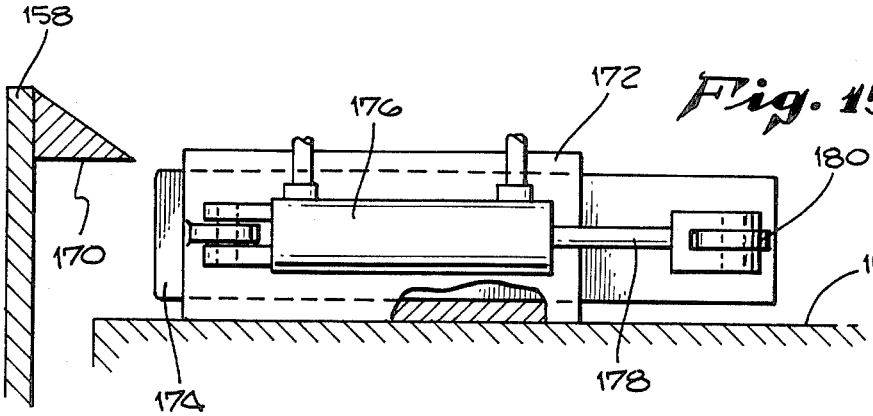
Fig. 15.
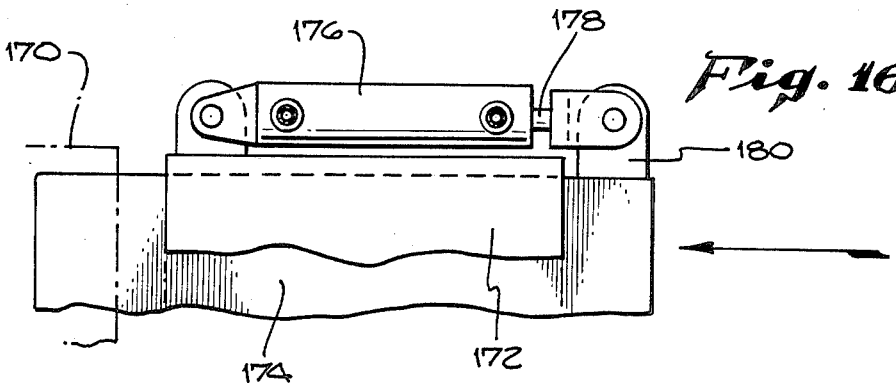
Fig. 16.

DRILLING, PRODUCTION AND OIL STORAGE CAISSON FOR DEEP WATER

BACKGROUND OF INVENTION

This invention relates to a floating caisson for use in offshore well operations including drilling, production and oil storage in deep water locations such as seven hundred feet or more.

Prior proposed offshore apparatus for well operations have included vertically moored tension leg platforms in which anchor lines are parallel or substantially parallel and vertically arranged. Such anchor lines are under high pretension to prevent the lines from going slack when waves pass through the platform structure. Failure of an anchor line may not only jeopardize the integrity of the platform, but also the risers connected therewith. The vertically moored tension leg platform is not adapted for laterally controlling the position of the platform relative to a sea floor template by adjusting tension or by adjusting the length of the anchor lines. Such a vertically moored tension leg platform is not suitable for connecting a riser to a sea floor well head by laterally positioning the vessel on the surface by use of anchor lines. Examples of tension leg platforms in the prior art are U.S. Pat. Nos. 3,648,638 and 3,780,685.

Another prior proposed offshore apparatus for well operations includes a floating vessel or semi-submersible vessel equipped with conventional catenary mooring lines which extend from the vessel to anchors on the sea floor which are often a substantial horizontal distance from the vessel. A usual conventional catenary mooring line may have a scope of at least 3:1, that is, a horizontal distance of 3 to a vertical distance of 1. In some instances the scope may be as much as 7:1. An anchor pattern for such a floating or semisubmersible vessel will cover a very wide sea floor area. Such an anchor pattern may cause problems in sea floor installations because of the fouling of the anchor lines with other subsea well equipment. Further, in deep water operations with such a conventional catenary moored floating vessel, a small watch circle, that is the sea floor area designated by the arrangement of anchor means is not possible or feasible. Examples of such conventional catenary mooring lines are shown in U.S. Pat. Nos. 3,778,854 and 3,360,810.

In such offshore operations the platforms are provided with a connection to a riser system which extends from the platform or floating vessel to the sea floor for connection to a well head or other subsea well installation. Such riser systems require tensioning means comprising sheaves, wire rope and hydraulic cylinders to maintain a relatively constant tension on the end of the wire rope to provide the necessary upward vertical force to support the riser means. Such prior proposed riser tensioning means are mechanical devices which are subject to wear and require continuous maintenance. They also occupy substantial space under conditions where space is usually limited by the design of the platform or vessel. In some riser tensioning systems flotation devices are employed and are attached adjacent to the upper end of the riser. In such flotation tensioning systems the riser system is generally exposed to wave forces which in acting on the flotation unit result in undesirable stresses in the riser. An elongated well head structure which is buoyant and which receives therewithin a riser supported by a flotation means is disclosed in Daniell U.S. Pat. No. 3,470,838.

In some instances the riser tensioning means includes a combination of flotation units and tension means in which floats are attached along the length of the riser to partially support the riser weight; and the remaining riser weight is supported by hydraulic tensioning means at the platform as mentioned above.

Storage of oil at sea has included spar buoy type constructions such as shown in Rusking U.S. Pat. No. 3,360,810 and Kapteijn, et al. U.S. Pat. No. 3,921,557. Spar buoy constructions have also been used for mooring and oil transfer purposes in water depths much less than deep water (seven hundred feet or more).

SUMMARY OF INVENTION

The present invention contemplates a deep draft floating caisson adapted to be utilized for drilling, production and oil storage in a deep water environment of up to several thousand feet or more. A caisson structure embodying the present invention is characterized by its extreme deep draft, straight sides, large displacement, and permanently moored with multi-point taut catenary mooring lines and anchor pile means in which the scope of the catenary mooring lines is low, such as from 1:1 or less. The caisson of this invention may be cylindrical throughout its length and is provided a length in which its normal draft places the bottom of the caisson at a location so far below the surface of the water that the effect of waves is attenuated to very low amplitudes so that wave excitation forces will be relatively small. The heave motion of such a deep water caisson may be thereby reduced to almost zero even in the most severe seas while surge, sway, roll and pitch horizontal motions will remain within readily acceptable limits.

The invention further contemplates a taut or tensioned anchoring system which provides a small watch circle. The mooring lines of the present invention are adapted to be connected with the lower portion of the caisson either at the very bottom thereof or at a location above the bottom depending upon the location of the center of gravity and center of buoyance in order to provide minimum heel or tilting effect.

The invention further contemplates a floating caisson of cylindrical form with large displacement in which variable ballast chambers are provided at the top of the caisson with structural strength to withstand external hydrostatic pressures to a depth of approximately 250 feet and below this depth to provide oil storage chambers which are pressure equalized to the sea by communication with sea water and which do not require the structural strength of the upper chambers although they are at a depth where external sea pressure is greater.

The invention further contemplates a floating caisson with straight sides adapted to have a deep draft in which the caisson is provided with a center well or passageway within which is received a plurality of production risers and which may also be utilized for receiving a drilling string. The invention contemplates that each of the riser pipes be independently and separately supported by a flotation tank or unit and since the water within the center well is virually still because of the deep draft, a passive means for supporting the riser is provided.

The primary object of the present invention therefore is to provide a novel offshore apparatus for drilling, production and oil storage operations.

An object of the invention is to provide a floating caisson of straight sides throughout its length having a deep draft to the extent that the effect of excitation forces caused by waves and current are reduced to a minimum.

Another object of the invention is to provide a floating cylindrical caisson having a through passageway or center well within which a riser system and drilling system can be provided.

Another object of the invention is to provide a floating caisson having a center well receiving a plurality of risers in which each of the risers is independently supported by a separate buoyancy tank.

Another object of the invention is to provide a guide means for each buoyancy tank in the center well of the caisson.

A further object of the invention is to provide a novel counterbalance means for the drilling riser system in the center well of the caisson and in which the counterbalance means contributes to the fixed ballast means for maintaining vertical position of the caisson in the water.

A further object of the invention is to provide a floating caisson having deep draft in which the means for anchoring the caisson includes mooring lines adapted to be connected to the lower portion of the caisson and to be connected to a plurality of anchor pile members and in which the scope of the mooring lines is 1:1 or less to provide a small watch circle or anchoring area.

A still further object of the invention is to provide novel anchor pile means for facilitating anchoring mooring lines in a small watch circle.

Other objects and advantages of the present invention will be readily apparent from the following description of the drawings in which an exemplary embodiment of the invention is shown.

IN THE DRAWINGS

FIG. 14 is a top plan view of a locking means for the anchor pile means shown in FIG. 13.

FIG. 15 is a side elevational view of the locking means shown in FIG. 14.

FIG. 16 is a partial plan view of the locking means shown with the locking dog in locking position.

DETAILED DESCRIPTION

Figure 1:
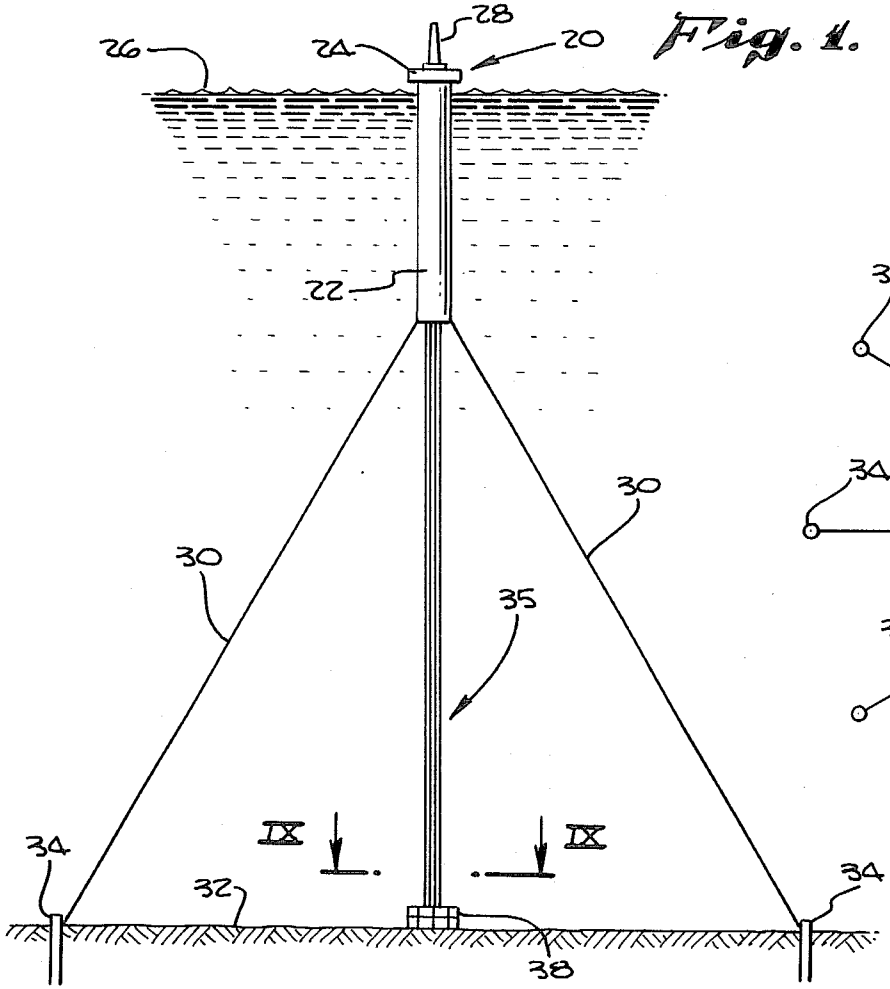
FIG. 1 is an elevational view of a caisson means embodying this invention installed in deep water, anchored with taut mooring lines, and showing a riser system connecting a subsea installation with the caisson means.

In FIG. 1 a drilling, production and oil storage deep draft caisson means is generally indicated at 20 and generally comprises an elongated cylindrical caisson 22 having a platform deck 24 located above the water surface 26 and adapted to support a drilling rig 28 and other drilling and production equipment (not shown). The cylindrical caisson is anchored by a plurality of taut mooring lines 30 secured at one of their ends to the sea floor 32 by anchor pile means 34. From the bottom portion of the cylindrical caisson 22 may extend a plurality of riser pipes 36 forming a riser system generally indicated at 35 and suitably connected to a sea floor template 38 at the sea floor 32.

CAISSON MEANS

Figure 3:
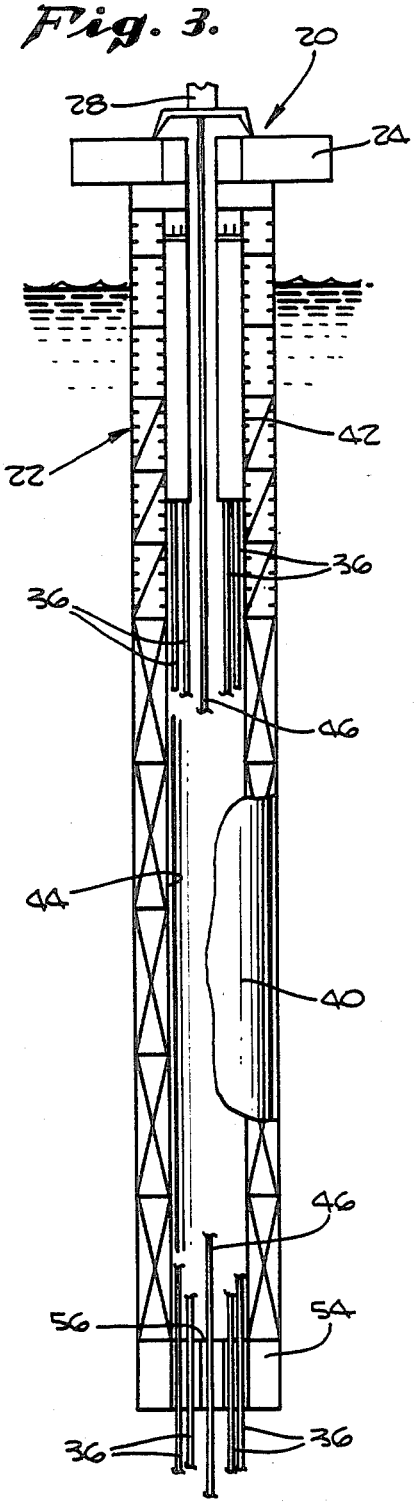
FIG. 3 is a schematic sectional view taken in a vertical plane passing through the axis of the caisson means, a fragment of the caisson wall being shown.
Figure 4:
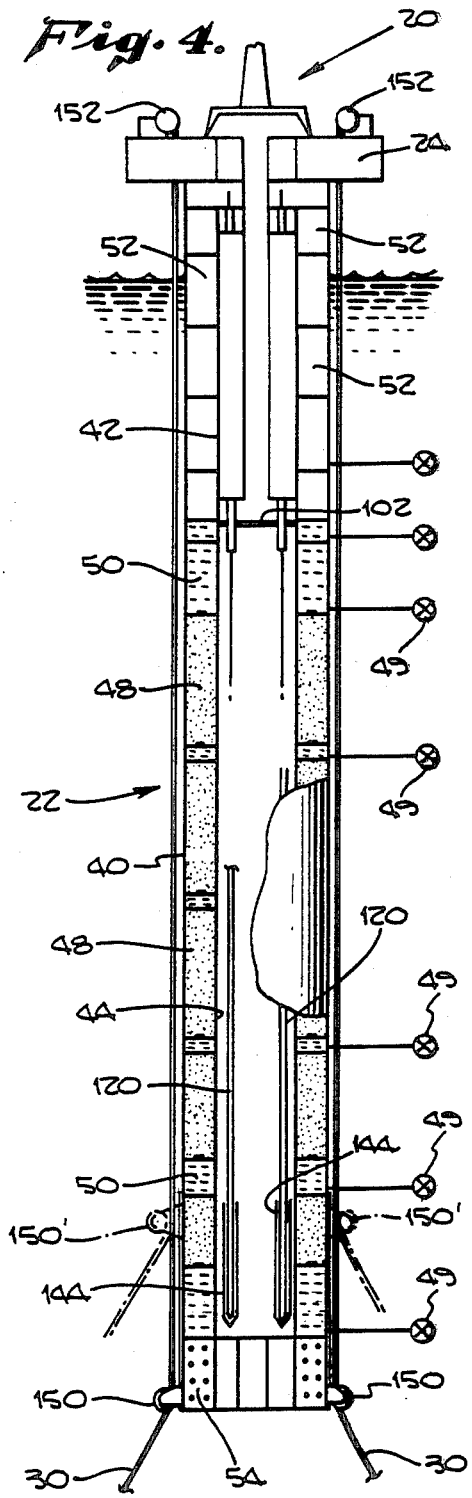
FIG. 4 is a schematic sectional view taken in a vertical plane passing through the axis of the caisson means, showing compartmentation of the caisson with oil and water stored in the several compartments and a portion of the mooring means.
Figure 5:
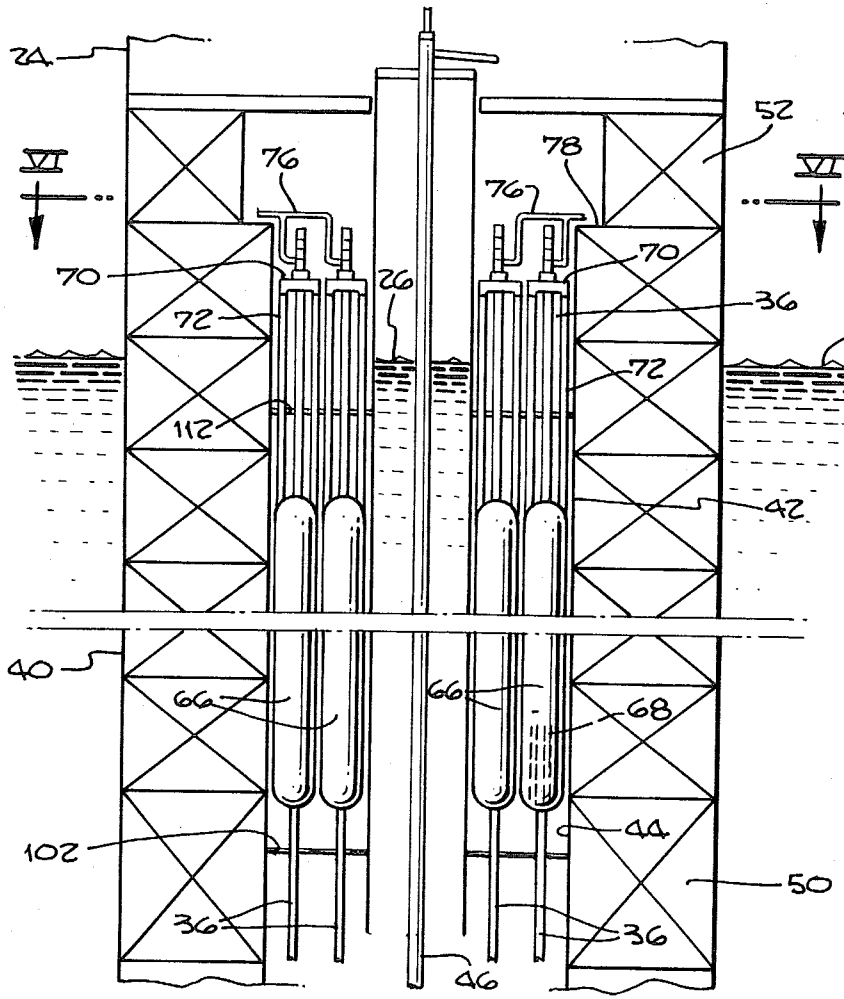
FIG. 5 is an enlarged schematic sectional view taken in a vertical plane of the top portion of the caisson means showing independent riser support means for each riser.
Figure 8:
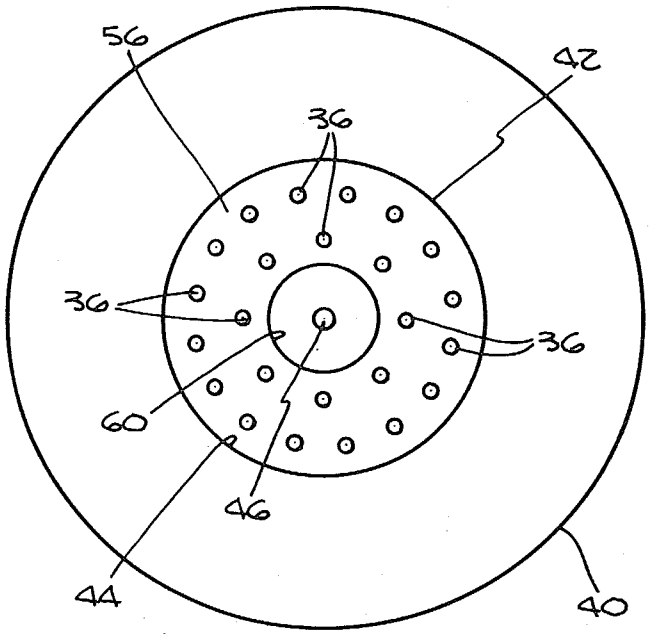
FIG. 8 is a transverse sectional view taken in the plane indicated by line VIII—VIII of FIG. 7.

The cylindrical caisson 22 and its features are best shown in FIGS. 3, 4 and 5. In this example of the invention cylindrical caisson 22 may comprise an elongated cylindrical caisson having a length of 700 to 800 feet. External cylindrical or hull wall 40 is provided with straight sides extending continuously from the bottom of the caisson 22 to the deck 24. An exemplary diameter of hull wall 40 may be about 90 to 100 feet depending upon desired storage capacity and displacement.

The length of the caisson and the amount of deep draft capable of being drawn by the caisson is a primary parameter. Consideration of the maximum significant wave and its period prevalant in the location where the caisson is to be used facilitates the selection of a deep draft wherein the effect of waves on the caisson is attenuated to a very small amount at the bottom of the caisson, such amount being as little as 1% of the resultant force acting on the caisson. As a result, heave or vertical motion of the caisson caused by wave action is minimal. Further, the motions of pitch, roll and surge acting on the caisson are reduced by the deep draft of the caisson and are within acceptable limits. The computation of such wave induced response of the deep draft caisson may be made by the Morison formula for fluid forces acting on a slender cylindrical body or by a wave diffraction theory procedure.

Within hull wall 40 is provided a concentric internal hull wall 42 which defines a central passageway or center well 44 extending throughout the length of caisson 22. The center well 44 provides space for riser system 35 and also a drilling system 46. The annular space between internal wall 44 and external wall 40 may be suitably divided into a plurality of lower oil storage compartments 48, upper variable water ballast compartments 50, and top work and equipment spaces 52. The radius of the hull wall 44 may be, in this example, about 26 feet and provides sufficient clearance for assembly of the riser system 35, drilling system 46, and for the passing therethrough in the center well of well equipment such as wellheads, blowout preventers and the like.

The upper portion of the caisson means 22 which includes the variable ballast tanks 50 and which may extend approximately 250 feet below the surface of the water is structurally fabricated (hard tank construction) to withstand external water pressures occurring at such depths. The outer hull wall 40 may be suitably reinforced by an arrangement of T section ribs. Such hard tank construction permits flooding of the variable ballast tanks with varying amounts of sea water depending upon the loading at the deck and work spaces and also depending upon the amount and type of oil being admitted to the oil storage compartment 48 in order to maintain a desired draft and a selected relationship between the center of gravity and center of buoyancy of the caisson means and loads carried thereby.

The oil storage compartments 48 which are located below the variable ballast tanks 50 may include outer and inner hull walls 40 and 44 of structural fabrication (soft tank construction) which is not required to withstand external hydrostatic water pressures existing at the depth at which the compartments 48 are located. Suitable sea water inlet and outlet valves 49 in such tanks 48 provide equalization of external and internal hydrostatic pressures at such depth during storage of different amounts of oil in the compartments. Oil, being lighter than water, assumes a position above the sea water and above valves 49 in compartments 48. In some instances, it may be desirable to provide facilities for removing oil which may have intermixed with the sea water at the oil-water interface in the event the sea water ballast from oil storage tanks is to be discharged into the ocean.

Figure 7:
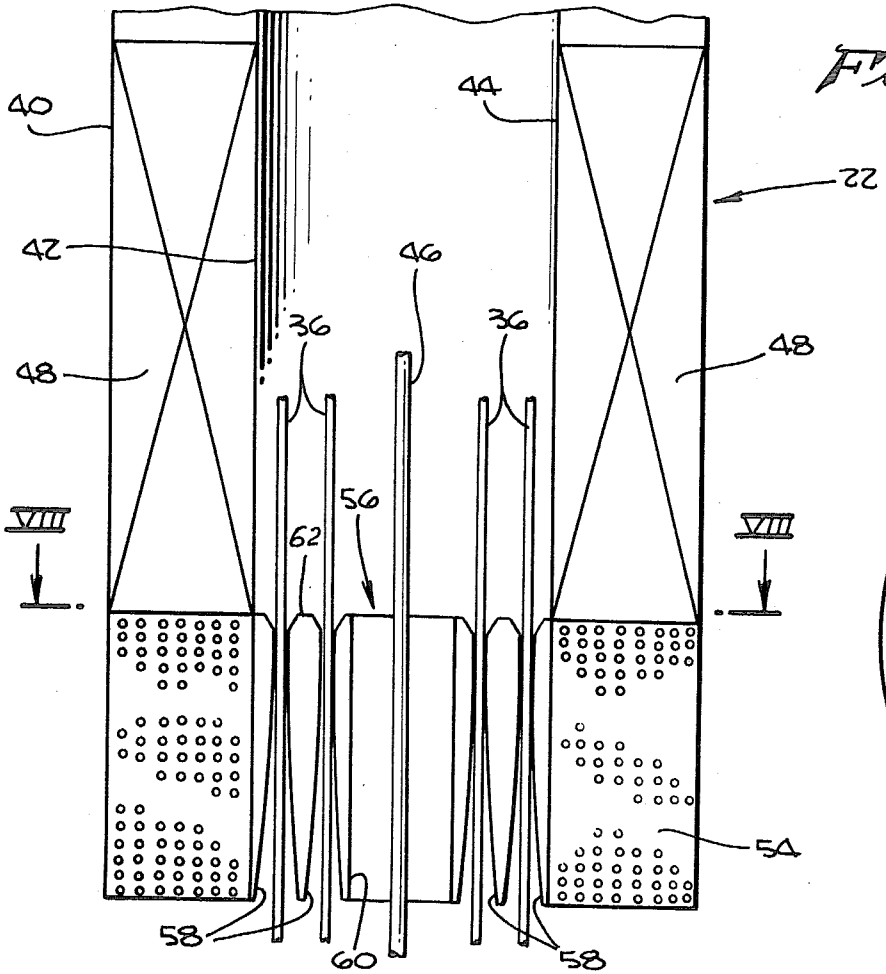
FIG. 7 is an enlarged fragmentary vertical sectional view of the lower portion of the caisson means showing guide means for the riser.

The bottom portion of caisson means 22, FIGS. 4 and 7, may be provided with suitable fixed ballast 54 of selected weight, such as concrete materials or other heavy materials. The fixed ballast 54 contributes to the maintenance of the caisson means 22 in a vertical position when tilted to upright position at the well location after transport thereto in a horizontal position.

In FIG. 7, center well 44 in the lowermost portion thereof and opposite fixed ballast 54 may be provided with guide means 56 for pipes 36 of the riser system 35. Guide means 56 includes for each of riser pipes 36 a downwardly and outwardly flaring passageway 58 to reduce bending stress on each riser pipe during lateral movement of the caisson with respect to its position above sea template 38. Drilling pipe 46 may not be restrained by guide means 56 and is substantially free to move laterally depending upon conditions encountered during drilling within the limits of the passageway 60.

It should be further noted that since wave induced motions at the bottom of the deep draft caisson means 22 are significantly attenuated, bending stresses on the riser pipe 36 at guide means 56 are readily accommodated within the flared passageways 58.

RISER SYSTEM

Figure 6:
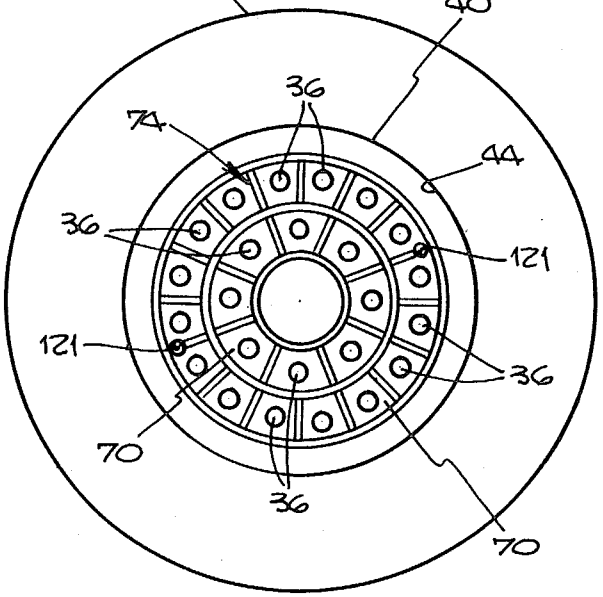
FIG. 6 is a transverse sectional view taken in the plane indicated by line VI—VI of FIG. 5, showing the riser arrangement and frame work with the top riser termination means removed.

The riser system 35 may comprise a plurality of separate independent riser pipes 36 arranged in concentric circles within the center well 44 as shown in FIGS. 5 and 6. In this example, 8 riser pipes are shown in the inner circle and 16 riser pipes are shown in the outer circle.

Figure 11:
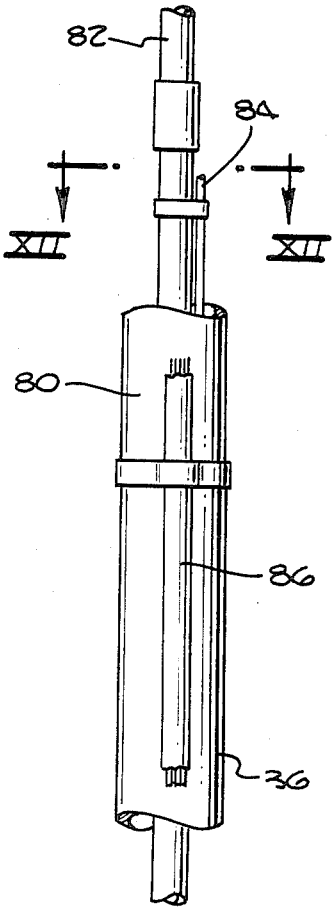
FIG. 11 is a fragmentary enlarged view of a typical portion of a riser used in the riser system of this invention.
Figure 10:
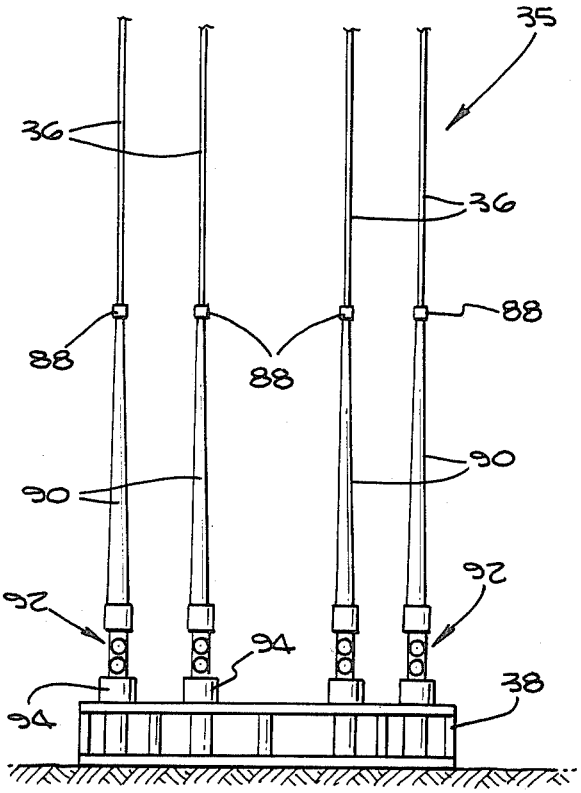
FIG. 10 is an enlarged fragmentary view of the sea floor template with risers connected thereto.
Figure 12:
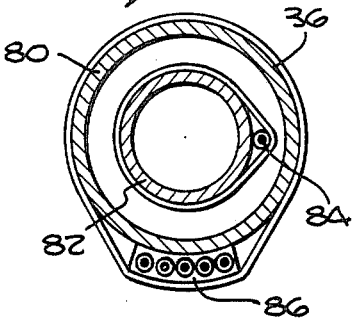
FIG. 12 is an enlarged sectional view taken in the plane indicated by line XII—XII of FIG. 11.

Each riser pipe 36 may include the construction shown in FIGS. 11 and 12. Each riser pipe 36 includes an external pipe 80 of for example $7\frac{5}{8}''$ diameter within which may be provided a tubing 82 of smaller diameter to which may be attached a valve control line 84 for operating a safety valve at the well head. On the external surface of pipe 80 may be provided a suitable hydraulic control bundle 86 for hydraulically operating the various well head equipment at the sea floor template which is associated with each riser pipe 36.

At the sea floor each riser pipe 36 may be connected as at 88 to an elongated tapered pipe section 90 connected by connector means 92 to a well head 94 at the subsea template 38. The tapered pipe sections 90 provide a bending stress relief construction where the connection to the wellhead is fixed. A flexible connection between each riser pipe 36 and its associated wellhead may also be used.

Figure 9:
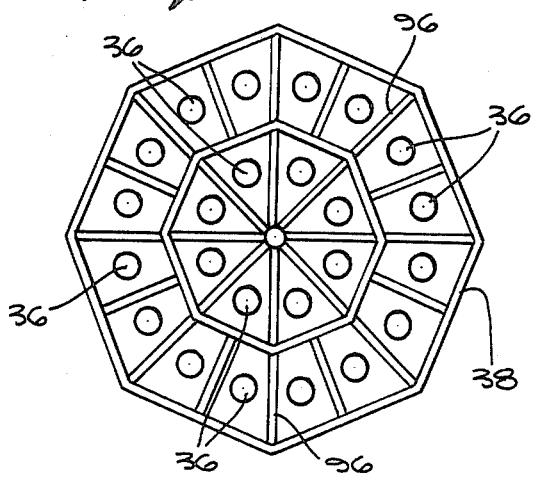
FIG. 9 is an enlarged schematic view of the sea floor template taken from the plane indicated by line IX—IX in FIG. 1.

The template 38 is illustrated in FIG. 9 as being of octagonal configuration and provides a template frame 96 with openings arranged and corresponding to openings provided for the riser pipes 36 in the deck frame means 74 as shown in FIG. 6. Other sea floor template facilities and pattern arrangements for a plurality of riser pipes may be made and accomodated within corresponding patterns in the sea floor template and in the central well of the caisson means.

Figure 17A:
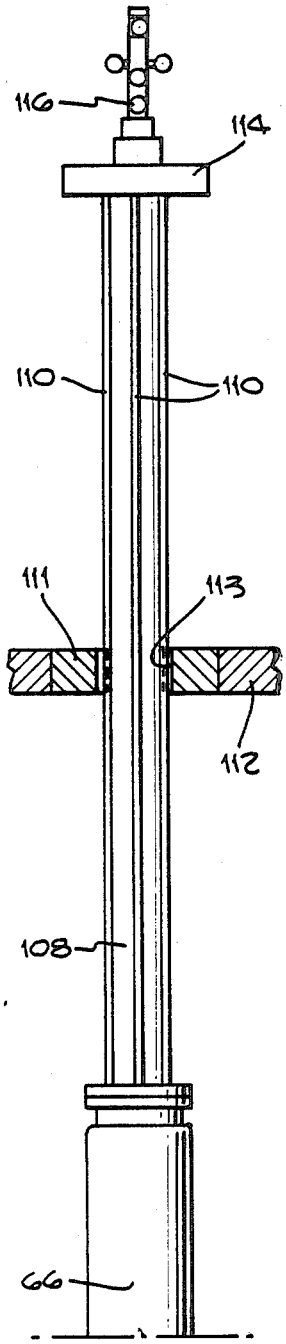
FIGS. 17A and 17B are elevational views showing the buoyancy tank means 66 with guide means therefore, the guide decks being shown in section.
Figure 17B:
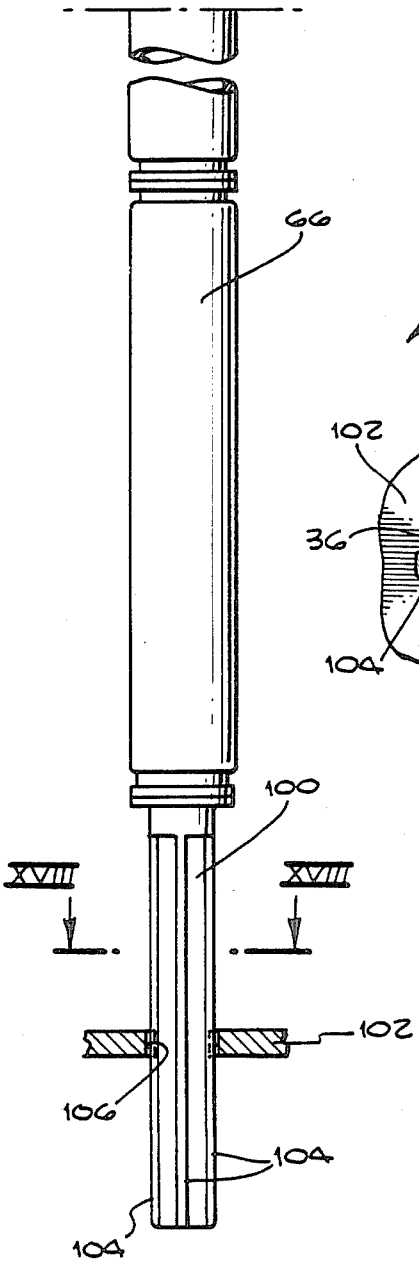
Figure 18:
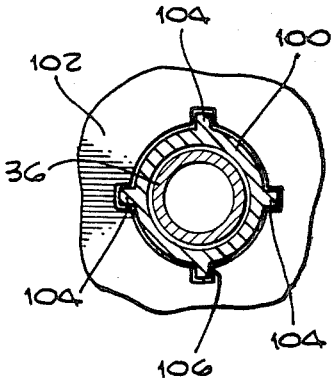
FIG. 18 is a transverse sectional view taken in the plane indicated by line XVIII—XVIII of FIG. 17B.
Figures 19A, 19B:
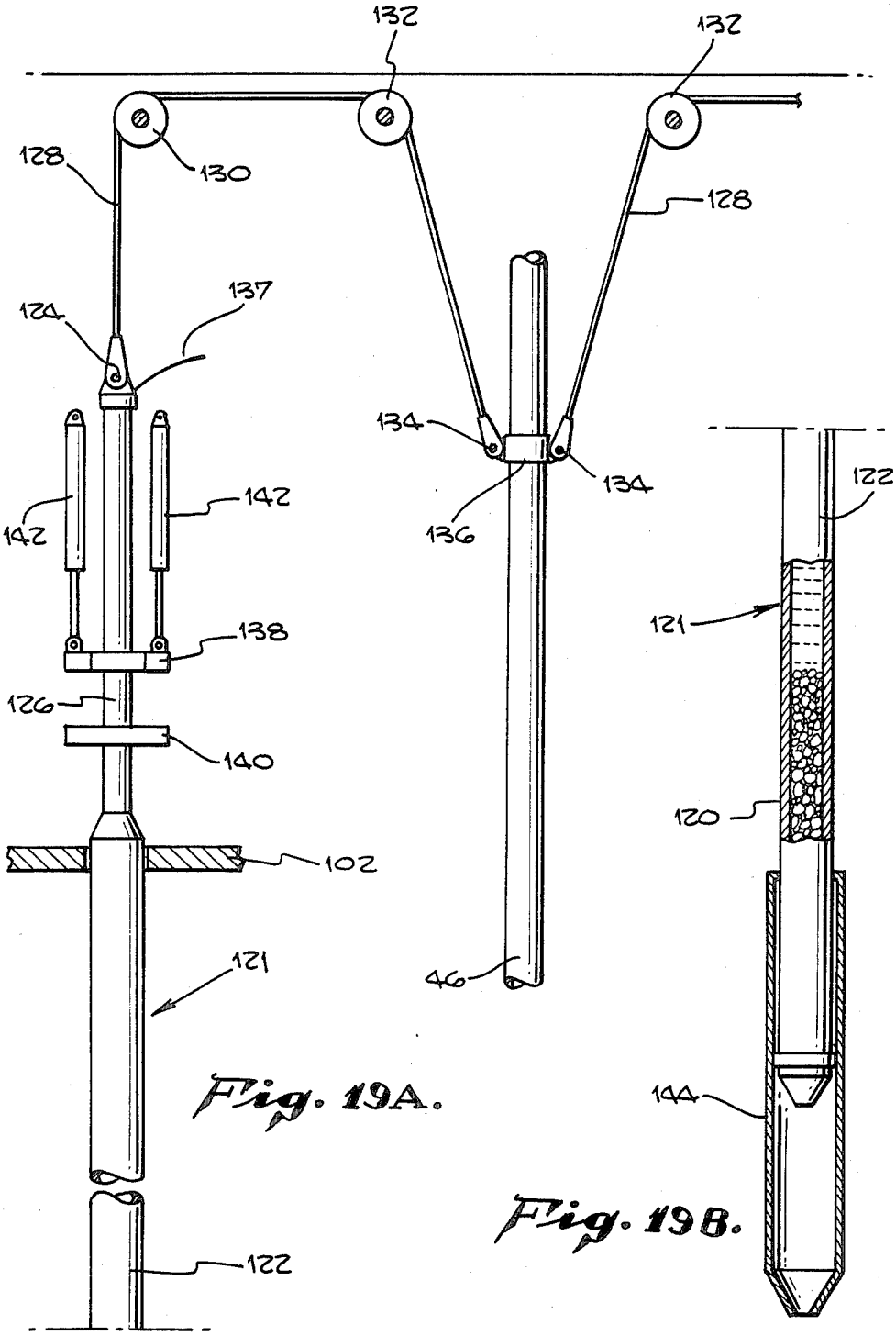
FIG. 19A and FIG. 19B are schematic elevational views of a counterbalance means utilized with the drilling system of this invention.

Each of the riser pipes 36 extend upwardly from the subsea template 38 and enter the bottom portion of the caisson means through the guide means 56 as previously described. Extending upwardly in the center well 44 each of the riser pipes may be guided in spaced parallel relationship by annular guide means 62 secured to the inner caisson wall 42 in suitable manner as by welding and having openings therein of corresponding pattern and configuration as the sea floor template. Each riser pipe 36 extends into a buoyant tank means 66, passes therethrough, emerges from the top of the buoyant tank means 66, and terminates at a well deck 114 (FIG. 17A).

Each riser 36 is buoyantly supported by the buoyant tank means 66. Each tank means 66 provides an axial passageway 68 for through passage of the riser pipe 36. Guide means for relative vertical movement of the tank means includes a lower stem 100 connected to the bottom portion of each tank 66 and extending through a bottom guide deck 102 of annular form which is secured to the internal surfaces of the caisson wall 44. Bottom stem 100 may be provided with angularly spaced (such as 90°) longitudinally extending guide ribs 104 which extend through guide recesses 106 formed in the inner circumferential margin of guide plate 102.

At the top of each buoyant tank means 66 may project a top stem 108 provided with angularly spaced guide ribs 110 which pass through an upper buoyant tank guide deck 112 with guide recesses 113 in a manner similar to that described for bottom stem 100. At the top of top stem 108 of each buoyant tank 66 is provided a well deck 114 in the associated opening in frame means 74. Each well deck 114 supports an exemplary Christmas tree 116 connected to the upper end of a riser pipe 36. Each riser pipe 36, after entering the caisson means, is thus guided with respect to the caisson means by the caisson guide means 56 and 62 and then by guide stems 100 and 108 of the tank means 66 in guiding engagement with the bottom and upper guide decks 102 and 112, respectively. The upper and lower guide decks 102 and 112 maintain the buoyant tank means 66 in proper spaced relationship within the center well 44. Alternatively or deck 114, to the upper end of guide stem 108, each well deck 114 may be supported by vertical column members 72 rising upwardly from the top end of buoyancy tank 66. Vertical column members 72 may be guided by part of the framework means generally indicated at 74 (FIG. 6) and carried by caisson wall 42.

The bottom end of caisson 22 is open to sea water and sea water fills the center well 44 to about the level of the sea surface 26. Such sea water within the center well 44 is relatively still since it is protected by the caisson means from wind, wave and sea currents. The effect of water movement present at the bottom of the caisson means which may be approximately 700 to 800 feet below the water surface and the excitation forces resulting therefrom at the top of the relatively still water column within the central well 44 are not significant. The buoyancy tank means 66 within the well 44 are subjected to minimal lateral forces relative to the caisson and wave forces resulting in heave motion are also minimized by the deep draft of the caisson means.

Guide decks for the riser pipes 36 below the bottom stem 100 and above the guide means 56 may also be provided if necessary.

Above the well deck 114 the piping 76, FIG. 5, may extend to a manifold deck 78 and manifolded thereon in suitable manner for communication with processing or production equipment and ultimately to the oil storage compartments 48. Such piping is well known and is not shown.

DRILLING SYSTEM

When drilling a well with the caisson means of this invention, it will be understood that in some instances there may be no riser pipes 36 rising upwardly from the sea floor template and that the drilling string is drilling a first well in the sea floor template. Depending upon the depth of water and the distance between the bottom caisson 22 and the sea floor, it may be possible to drill a well in the sea floor template in the presence of production risers 36.

As shown in FIGS. 3 and 5, a drilling string 46 extends axially through the center well 44 of caisson 22 and passes through bottom guide means 56 of the caisson to the sea floor template 38. Drilling string 46 may be supported and operated from a drilling rig 98 in well known manner, the rig 28 being carried by the platform deck 24 and the drill string loaded in usual manner.

The deep draft caisson means 22 when used in the drilling mode also provides a construction particularly adapted to utilizing counterweight means 121 for the drilling riser string. Such counterweight means 121 may include one or more elongated lower cylindrical weighted sections 120 and upper light sections 122 and 126 arranged in the center well 44 radially outwardly of riser pipes 36 and in spaces between adjacent buoyancy tanks 66. Four or more counterweight means may be utilized and arranged at 90 degrees; only two of such counterweight means 121 in diametrically opposite relation being shown in FIG. 6.

The cylindrical weighted sections 120 may be filled with suitable heavy materials such as steel punchings and may be located at the lower end of the counterweight means 121 which may have a length of 700 feet or more and thus, are positioned adjacent the bottom end portion of the caisson means. Such counterweights located at and adjacent to the bottom portion of the caisson means augments the fixed ballast 54 and may assist in controlling the location of the center of gravity of the caisson means and the vertical position of the caisson means when in the drilling mode.

The bottom weighted section 120 may be connected by suitable couplings, not shown, to the at least partially sea water filled upper light section 122 which is joined to a reduced cylindrical pipe section 126 having at its top a connection at 124 to a supporting cable line 128. The cable line 128 passes over laterally spaced sheaves 130, 132 supported from the platform. The ends of each cable line 128 may be connected at 134 to a collar bearing means 136 carried by drilling riser string 46 and permitting relative rotation between the drilling riser string and the connection at 134.

The upper light section 122 is partially filled with water for additional variable ballast. Air under pressure may also be introduced into light section 122 to adjust buoyancy. Air under pressure may be injected into the counter balance means at 137 through suitable air pressure lines, not shown.

Means for adjusting and positioning the counterbalance means weighted section 120 relative to the caisson means may include a traveling elevator 138 supported from the center well wall 42 by hydraulic rams 142 which are adapted to incrementally or step by step raise or lower the counterbalance means to adjust the height of the weighted section 120. A standing elevator 140 carried by the center well wall 42 provides a stationary support for the counterbalance means when a selected position has been determined by the hydraulic rams 142. The rams may thus selectively position the counterbalance means relative to the caisson means and when such selected position is reached, the standing elevators may support the counterbalance means from the caisson wall 42.

The lower end of the cylindrical weighted section 120 may be received within a dash pot cylindrical casing 144 which is filled with sea water so as to cushion excessive downward travel of the weighted section if a cable line, 128 should fail during the drilling operation.

In operation of the counterweight means 121 for drilling, the weight of the drilling riser string is selectively counterbalanced and such counterbalancing may be adjusted over a relatively wide range of loading by varying the amount of steel punchings carried in the weighted section 120, by the proportion of water and air in the light section 122, and by the use of one or more of the counterweights means 121 provided in the center well of the caisson means.

TAUT MOORING MEANS

Figure 2:
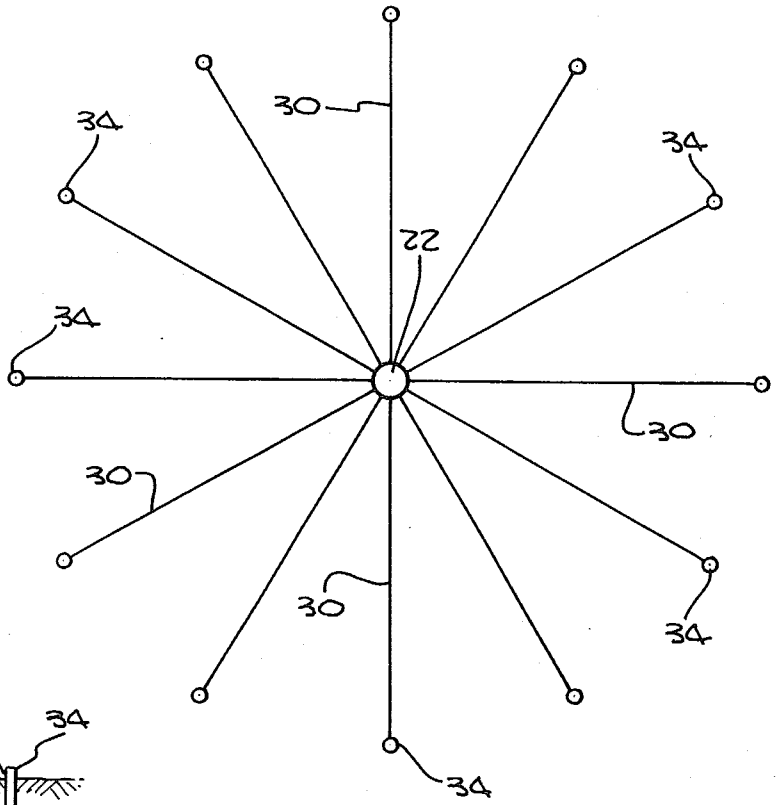
FIG. 2 is a plan view taken from the lower portion of the caisson means of FIG. 1 illustrating a 12 point mooring means having a small watch circle.

In FIGS. 1 and 2 twelve mooring lines 30 illustrate the small watch circle provided by the scope of the mooring lines which extend from the bottom portion of the caisson means 22 to the sea floor. At the sea floor each mooring line is anchored as generally indicated at 34, such anchoring means being shown in greater detail in FIGS. 13, 14 and 15.

As shown in FIG. 4 each mooring line 30 passes through a fairlead 150 located at the bottom portion of the caisson means. Fairlead 150 may also be associated with the bottom portion of the caisson as indicated by fairlead 150', a selected distance above the bottom of the caisson means depending upon the angle of heel to be permitted when the upper part of caisson means 22 is responding to wind, wave and water currents. Each mooring line 30 extends upwardly along the external surface of the caisson 40 and its upper end may be connected to winches 152 carried on the platform deck 24 or at other suitable work space areas below the deck 24. The winches 152 serve to place each mooring line 30 under tension to maintain a generally straight mooring line between anchor means 34 and the connection to the bottom portion of the caisson.

As noted above, since the bottom of the deep draft caisson is not significantly affected by wave and wind forces acting on the caisson. The 12 taut straight mooring lines shown in FIG. 2 will maintain the bottom of the caisson in relatively unchanging position with respect to the sea template 38. Maintensnce of such a substantially unchanging position serves to minimize bending stresses on the riser system 35 at the sea floor template 38 and at the bottom of the caisson.

The deep draft location of the caisson body also affords the use of a relatively small watch circle and mooring lines 30 have a scope of 1:1 or less because the horizontal component of forces acting on the bottom of the deep draft caisson are substantially reduced.

The position of the deep draft caisson relative to the sea floor template may be readily controlled by adjusting and varying the length and tension in the mooring lines 30 by the winch means 152 at the platform deck. There may be redundancy in the mooring lines 30 so that if one mooring line should break, the position of the caisson would not significantly change to unduly stress the riser system.

The effect of wind, waves and currents on such a taut moored deep draft caisson may cause tilting of the caisson about the points of attachment of the mooring lines to the bottom of the caisson. The caisson is considered to be at constant draft with the center of gravity of the entire caisson means; that is, the deck and well equipment thereon, hard tanks, soft tanks, fixed ballast, oil, and variable ballast, at a selected point above the bottom of the caisson and below the center of buoyancy to maintain an adequate righting moment to keep the angle of heel of the caisson less than 6° in the most severe expected storm. An angle of heel of 6° will not be exceeded in the above described exemplary deep draft caisson if the center of gravity is maintained at least 25 feet or more below the center of buoyancy. Control of the location of the center of gravity is accomplished by varying the sea water ballast in compartments 50, oil volume and oil type, and the proportion of oil and sea water contained in oil storage compartments 48.

The angle of heel may be reduced by moving points of connection of mooring lines 30 to the bottom of the caisson upwardly toward the center of gravity to shorten the lever or moment arm acting about the mooring line connections to the bottom of the caisson. Such relocation of the taut mooring line connection was briefly described hereinabove. Adjustability of such mooring line connection to the bottom portion of the caisson may also be accomplished by providing vertically movable and guided fairleads 150' on the exterior of the caisson hull 90. Such guiding means may include vertically arranged rails on which the fairleads 150' may travel and suitable winch means for moving the fairleads vertically along the rail guides to a selected position above the bottom of the caisson 22. When a selected position for fairlead 150' is reached, the fairleads may be locked in place by a suitable locking means, not shown.

Figure 13:
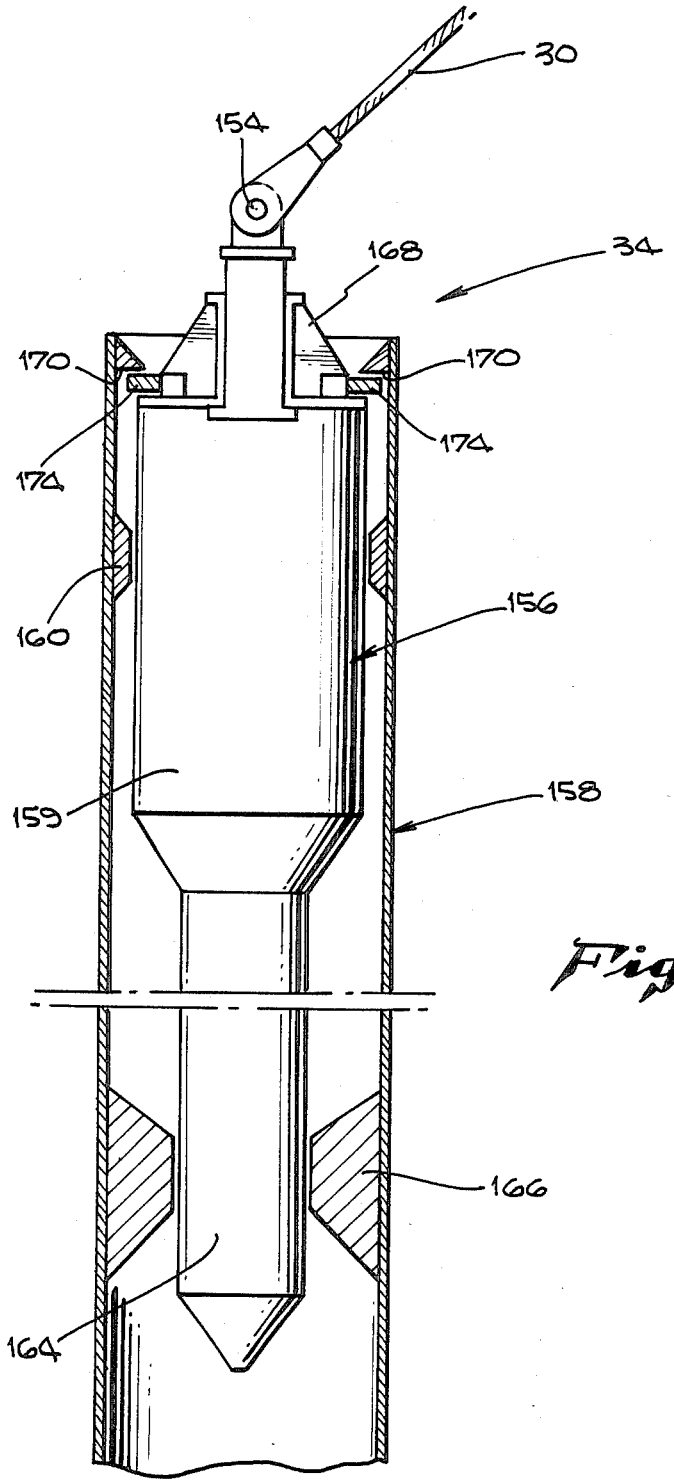
FIG. 13 is a vertical sectional view of a pile anchor means.

An exemplary anchor means 34 is shown in FIGS. 13, 14 and 15. The bottom end of anchor line 30 may be connected by a pin 154 to a stabbing pin means 156 received within an anchor pile cylindrical member 158 which extends downwardly into the sea floor and may be cemented in place in well known manner. Stabbing pin 156 is provided an upper cylindrical portion 159 which is guided by centralizer means 160 within the anchor pile member 158. The enlarged cylindrical portion 159 is connected with a reduced cylindrical stabbing pin portion 164 which at its bottom end is guided by centralizer means 166 provided on the pile member 158. The top portion of the stabbing pin is provided a swivel 168 to permit rotation of the pin 154 about the axis of the stabbing pin.

Means for locking the stabbing pin within the anchor pile member 158 may include an annular internal shoulder 170 provided on the upper end of pile member 158. On the top portion of stabbing pin 156 may be provided a housing 172 containing a slidable locking dog 174 which when actuated to locking position by a double acting hydraulic cylinder 176 will cause the locking dog to underlie the shoulder 170 and lock the stabbing pin against upward movement and removal from the pile member 158. A double acting hydraulic cylinder 176 on each side of the housing 172 includes piston rods 178 connected together by a transverse member 180 which is welded to the opposite end of locking dog 174.

INSTALLATION AND OPERATION

Caisson means 22 may be fabricated in cylindrical sections of suitable length, the sections being joined together to provide the selected entire length of the caisson means. The caisson means may be floated in horizontal position with the fixed ballast installed at the bottom end of the caisson. The caisson may then be progressively upended by controlling the introduction of sea water into the oil storage tanks until the caisson 22 is positioned vertically above the sea floor template. In such initial vertical position, the oil storage compartments 48 may be filled with sea water in order to maintain the pressure equilibrium required by the soft tank construction of that portion of the caisson means.

The mooring lines 30 may be each connected to its associated anchor pile means by stabbing the stabbing pin into the anchor pile member and actuating the locking dogs to lock the bottom end of the mooring lines 30 in the anchor pile means. The winch means on the platform deck may then selectively tension each mooring line and may vary the length of each mooring line until the bottom end of the caisson 22 is located at a desired position above the sea floor template 38. Limited lateral excursion of the bottom end of the caisson means may be readily controlled by the winch means at the deck until the selected position in the caisson is reached. Tension in the mooring lines may then be equalized, the tension being sufficient to maintain the mooring lines in an approximately straight line so as to assist in maintaining the caisson 22 in the selected position above the sea floor template and at a constant draft which is primarily maintained by controlling the amount of ballast water in the variable ballast tanks.

Each riser pipe 36 may be run through the central well 44 and connected to the sea floor template 38 in usual manner. Within the central well 44, each riser buoyancy unit 66 may be lowered through the upper decks by removing annular deck inserts 111 therein to enlarge the openings in the decks to permit the buoyancy tanks 66 to be lowered therethrough and to engage in the bottom stem 100 with the guide means in the bottom deck 102. After each buoyancy unit is located between the upper and lower decks, the upper deck may have its deck insert replaced so that the upper stem 108 of each buoyancy unit 66 is guidingly engaged by the upper guide deck. The buoyancy of each riser buoyancy unit 66 may be controlled by ballasting and deballasting. Each riser pipe 36 extends through the axial tube in the buoyancy tank 66 and extends upwardly through the well deck 114 for its connection to the Christmas tree on well deck 114. Selective ballasting of each buoyancy tank 66 in the still water within the central well 44 provides support for vertical loads imposed by the riser system and will maintain each riser pipe in selected tension and support. Since there may be slight variations in the elevation of each of the incremental well decks 114 to which each riser is connected through the buoyancy tank 66, the connections between the Christmas trees on the well decks and riser and manifold piping on the manifold deck 78 are made with flexible tubing or pipe sections with flexible joints.

Since the risers 36 are supported within the central well by buoyancy tanks 66 in still water, relative movement between the riser system and the caisson means at the buoyancy tanks is minimal and particularly with respect to heave motions.

When the oil storage compartments 48 are being filled with oil, it will be understood that the oil will displace the sea water in such compartments and such displacement will tend to vary the draft and the location of the center of gravity because of the difference in the specific gravity of oil and water. Such displacement of sea water by oil in oil storage compartments 48 may be compensated for by introduction of sea water into the variable ballast tanks 50 so as to maintain the draft and the center of gravity of the caisson means at a selected location.

It should also be noted that in the deep draft caisson construction described above that straight sides are provided for the caisson means at the water plane area. In other spar buoy type constructions, the spar buoy has included a narrowing portion at the water plane area in order to reduce the effect of wave action. In the deep draft construction of caisson means 22, such reduction in diameter of the upper portion of the caisson means is not required because of the length of the caisson means and the reduction of wave excitation forces acting on the caisson because of its deep draft as described hereinabove.

It will be understood that various modifications and changes may be made in the caisson means described above and all such changes and modifications coming within the spirit of the present invention and the scope of the claim appended hereto are embraced thereby.

I claim:

1. In a drilling, production and oil storage caisson for use in deep water offshore well operations, the combination of:

a cylindrical open-ended caisson of uniform cross section throughout its length and having a length such that its upper end extends above the water surface and provides a uniform water plane area and its bottom end is subject to only minimal excitation forces caused by waves;

said bottom caisson end having fixed ballast means;

said cylindrical caisson extending above the surface of the water and supporting a platform deck;

said cylindrical caisson having a central well extending, open at the bottom and containing water non-excited by waves, for the entire length of the caisson and defined by an inner cylindrical wall;

said caisson having an outer cylindrical wall of uniform diameter forming with said inner cylindrical wall a plurality of liquid storage compartments;

the uppermost of said storage compartments including variable ballast storage compartments;

the storage compartments below said variable ballast compartments being adapted to contain oil and ballast water;

certain of said uppermost compartments being constructed to withstand external hydrostatic pressures and said compartments below said uppermost compartments being constructed for equalized internal and external hydrostatic pressures;

a plurality of production risers, each extending into said central well in the caisson;

a separate buoyant means connected to each riser within the upper portion of said central well and in said non-excited water for supporting and tensioning the riser;

drilling means extending through the central well and within the arrangement of risers;

and taut mooring means extending from the lower portion of the caisson and anchoring the caisson to a sea bed.

2. A caisson as claimed in claim 1 including:

means for attaching the mooring lines to the lower portion of the caisson and including means for longitudinally positioning the attachment means relative to the center of gravity of the caisson and to the axis of the caisson to modify the amount of heel of the caisson.

3. A caisson as claimed in claim 1 including a plurality of anchor pile means arranged in a circle about the projection of the vertical axis of the caisson;

said anchor pile means including a cylindrical pile casing extending downwardly into the sea floor;

a stabbing pin received within said pile casing and having a swivel connection to one end of the mooring line;

and means for locking said stabbing pin within said casing.

4. A caisson as claimed in claim 3 including centralizer means in said pile casing for stabilizing said stabbing pin.

5. In a drilling, production, and oil storage caisson for use in deep water offshore well operations, the combination of:

caisson means having a length providing a natural period in excess of the period of a selected maximum design wave period and extending from above the water surface to a depth of such that its bottom end is subject to only minimal excitation forces caused by waves;

said caisson means having straight sides throughout its length and having uniform cross section throughout its length and providing uniform water plane area;

said caisson means including a plurality of oil storage chambers adapted to contain both oil and ballast water, a plurality of water ballast chambers above said oil storage chambers, and a through passageway from top to bottom of said caisson and extending through said chambers of a size adapted to pass well equipment therethrough;

riser means including a plurality of riser pipes in said passageway;

buoyant flotation means in said passageway for supporting and tensioning each of said riser pipes in said passageway;

drill means extending through said passageway between said riser means;

and taut mooring means extending from the lower portions of said caisson and having a relatively low scope of 1 to 1 or less.

6. A caisson as claimed in claim 5 including counterbalance means in said center well for said drilling means.

7. A caisson as claimed in claim 6 wherein said counterbalance means includes a weighted section adjacent the bottom portion of the caisson means.

8. A caisson as claimed in claim 6 wherein the counterbalance means includes elevator means for the counterbalance means, and ram means for adjusting the counterbalancing means to the elevator means.

9. A multiple riser pipe system adapted for use in a passageway in a caisson, the passageway being in communication with the sea, comprising, in combination:

an elongated flotation unit for each riser pipe received within the passageway of the caisson;

a top deck above said flotation unit for each riser pipe;

each riser pipe extending through said flotation unit and terminating at said top deck means supporting said top deck from said flotation unit;

riser connecting means carried by said deck including flexible coupling means;

spacer means in said passageway below said flotation units for guiding each of said riser pipes;

the bottom of said passageway being at a depth where wave induced excitation forces are minimal whereby water at the flotation unit for each riser pipe is virtually still.

10. In a deep draft caisson means for offshore drilling, production and oil storage, said caisson means having a center well; the provision of:

a riser pipe extending into said center well;

a buoyancy flotation means in said center well and connected to said riser pipe for supporting and tensioning said riser pipe;

guide means for the flotation means including stem means extending axially from said flotation means, and guide deck means in said center well cooperable with said stem means.

11. A caisson means as claimed in claim 10 wherein said stem means includes stem members extending from opposite ends of said flotation means, each stem member including guide ribs;

said guide deck means including guide recesses for said ribs.

12. A caisson means as claimed in claim 10 wherein said stem means support a well deck having a connection to the upper end of said riser pipe.

13. In a drilling, production and oil storage caisson for use in deep water offshore well operations, the combination of:

caisson means having a length providing a natural period in excess of a selected maximum design wave period, said caisson means having straight sides for its length, said caisson means including a plurality of oil storage chambers adapted to contain both oil and ballast water, a plurality of water ballast chambers above said oil storage chambers, and a through passageway through said chambers of a size adapted to pass well equipment therethrough;

riser means including a plurality of riser pipes in said passageway;

buoyant flotation means for supporting and tensioning each of said riser pipes in said passageway;

drill means extending through said passageway between said riser means;

taut mooring means extending from the lower portion of the caisson and having a relatively low scope of 1 to 1 or less;

counterbalance means in said through passageway for said drilling means and including a weighted section adjacent the bottom portion of the caisson means; and a section above said weighted section adapted to contain sea water and pressure air for ballasting the counterbalance means.

14. In an offshore drilling, production and oil storage apparatus, the provision of:

a caisson means of uniform cross-section throughout its length having an outer hull and an inner wall providing annular space with said outer hull, transverse partitions in said annular space providing oil storage compartments, water ballast compartments, and work compartments;

said inner wall providing a through center well in said caisson means;

riser guide decks carried by said inner wall;

a riser extending into said center well;

a buoyant tank within said center well connected with said riser for supporting and tensioning said riser;

co-axial guide stem means carried by said tank in cooperable engagement with said riser guide decks;

said hull and inner wall at said work and water ballast compartments being in the upper portion of said caisson means and constructed to withstand external hydrostatic pressure;

said oil storage compartments being below said other compartments and adapted to be equalized in hydrostatic pressure;

said caisson means having a length related to the maximum expected forces caused by wind, wave and currents whereby the bottom of the caisson is subjected to 1% or less of the maximum wave excitation forces and the caisson has a natural period in excess of said expected wave force.

15. In a drilling, production and oil storage caisson for use in deep water offshore well operations, the combination of:

an elongated open-ended caission having a lower end portion spaced from the sea floor and an upper end portion extending through and above the water surface, said caission having an outer surface of uniform configuration for the entire length of said caisson, said caisson being of uniform cross section throughout its length and extending to a depth of water where said lower portion is subjected to only minimal excitation forces caused by wave action on said caisson and the upper portion provides uniform water plane area during vertical movement of the caisson and changes in wave height;

said caisson comprising means including outer and inner walls defining compartments for liquid storage;

said upper portion of said caisson including hard tank construction for withstanding external hydrostatic pressures, said lower portion of said caisson having soft tank construction for permitting equalized external and internal hydrostatic pressures, the liquid storage compartments at said hard tank portion providing means for variably ballasting the upper portion of said caisson, the liquid storage compartments of said soft tank portion providing means for storage of oil and sea water;

said bottom portion having fixed ballast means;

said inner wall providing a central well extending through said caisson and containing non-excited water;

a plurality of production risers in said central well;

a buoyant means for each riser in said non-excited water in the upper portion of said well for supporting and tensioning each riser;

a drilling string extending through said central well;

a platform deck supported by the upper portion of said caisson and having a connection for said drilling string;

and mooring means extending from the lower portion of the caisson and anchoring said caisson to a sea bed.

16. In a drilling, production and oil storage caisson for use in deep water offshore well operations, the combination of:

a cylindrical open-ended caisson of uniform cross section throughout its length and having a length such that its bottom end is subject to only minimal excitation forces caused by waves;

said bottom caisson end having fixed ballast means;

said cylindrical caisson extending above the surface of the water and supporting a platform deck;

said cylindrical caisson having a central well extending for the entire length of the caisson and defined by an inner cylindrical wall;

said caisson having an outer cylindrical wall of uniform diameter forming with said inner cylindrical wall a plurality of liquid storage compartments;

the uppermost of said storage compartments including variable ballast storage compartments;

the storage compartments below said variable ballast compartments being adapted to contain oil and ballast water;

certain of said uppermost compartments being constructed to withstand external hydrostatic pressures and said compartments below said certain uppermost compartments being constructed for equalized internal and external hydrostatic pressures;

a plurality of production risers, each extending into said central well in the caisson;

buoyant means connected to each riser within the upper portion of said central well for supporting and tensioning the riser;

drilling means extending through the central well and within the arrangement of risers;

and taut mooring means extending from the lower portion of the caisson and anchoring the caisson to a sea bed;

means for attaching the mooring lines to the lower portion of the caisson and including means for longitudinally positioning the attachment means relative to the axis of the caisson to modify the amount of heel of the caisson;

said attachment means including a rail means on the caisson extending parallel to the axis of the caisson;

and a fair lead sheave means mounted on said rail means and over which said mooring line passes.

17. A cylindrical open-ended caisson of uniform cross section throughout its length and having a length such that its bottom end is subject to only minimal excitation forces caused by waves;

said bottom caisson end having fixed ballast means;

said cylindrical caisson extending above the surface of the water and supporting a platform deck;

said cylindrical caisson having a central well extending for the entire length of the caisson and defined by an inner cylindrical wall;

said caisson having an outer cylindrical wall of uniform diameter forming with said inner cylindrical wall a plurality of liquid storage compartments;

the uppermost of said storage compartments including variable ballast storage compartments;

the storage compartments below said variable ballast compartments being adapted to contain oil and ballast water;

certain of said uppermost compartments being constructed to withstand external hydrostatic pressures and said compartments below said certain uppermost compartments being constructed for equalized internal and external hydrostatic pressures;

a plurality of production risers, each extending into said central well in the caisson;

buoyant means connected to each riser within the upper portion of said central well for supporting and tensioning the riser;

drilling means extending through the central well and within the arrangement of risers;

and taut mooring means extending from the lower portion of the caisson and anchoring the caisson to a sea bed;

said mooring means including a plurality of anchor pile means arranged in a small circle about the axis of the caisson whereby said mooring lines may have a scope of between 1 to 1 and 0.5 to 1.

18. In a drilling, production and oil storage caisson for use in deep water offshore well operations, the combination of:

caisson means having a length extending from above the water surface to a depth such that its bottom end is subject to only minimal excitation forces caused by waves;

said caisson means having straight sides throughout its length and having uniform cross section;

said caisson means including a plurality of oil storage chambers adapted to contain both oil and ballast water, a plurality of water ballast chambers above said oil storage chambers, and a through passageway from top to bottom of said caisson and extending through said chambers of a size adapted to pass well equipment therethrough;

riser means including a plurality of riser pipes in said passageway;

buoyant flotation means for supporting and tensioning each of said riser pipes in said passageway;

drill means extending through said passageway between said riser means;

and taut mooring means extending from the lower portion of a caisson and having a relatively low scope of 1 to 1 or less;

said mooring means including mooring lines;

means for adjusting the attachment point of each mooring line to the lower portion of the caisson;

said means for adjusting the attachment point of the mooring line to the caisson including vertically adjustable moveable mooring line connecting means whereby the mooring line adjustment is displaced vertically upwardly to provide a connection closer to the center of gravity of the caisson than a connection at the bottom of the cassion.

19. In a drilling, production and oil storage caisson for use in deep water offshore well operations, the combination of:

an elongated open ended caisson having a lower end portion and an upper end portion, said caisson having an outer surface of uniform configuration for the entire length of said caisson, said caisson being of uniform cross section throughout its length and extending to a depth of water where said lower portion is subjected to only minimal excitation forces caused by wave action on said caisson;

said caisson comprising means including outer and inner walls defining compartments for liquid storage;

said upper portion of said caisson including hard tank construction for withstanding external hydrostatic pressures, said lower portion of said caisson having soft tank construction for permitting equalized internal and external hydrostatic pressures, the liquid storage compartments of said hard tank portion providing means for variably ballasting the upper portion of said caisson, the liquid storage compartments of said soft tank portion providing means for storage of oil and sea water;

said bottom portion of said caisson having fixed ballast means;

said inner wall providing a central well extending through said caisson;

a plurality of production risers in said central well;

a buoyant means for each riser in the upper portion of said well for supporting and tensioning each riser;

a drilling string extending through said central well;

a platform deck supported by the upper portion of said cassion and having a connection for said drilling string;

and mooring means extending from the lower portion of the caisson and anchoring said caisson to a sea bed;

said caisson including stem means associated with each riser above and below said buoyant means, said stem means having guide means thereon;

and a guide deck in said center well having guide means cooperable with said stem guide means.

20. A caisson as claimed in claim 19 wherein said stem means above said buoyant means provides support for a riser deck.

21. In a deep water offshore apparatus for use in drilling, production and oil storage, the combination of:

an elongated caisson having an upper end portion above the water surface and a lower end portion extending to a water depth subject to only minimal excitation forces caused by wave action, said caisson having an outer surface of uniform configuration for the entire length of said caisson and providing uniform water plane area, said length of said caisson below said water plane area providing a caisson natural period in excess of a selected maximum expected wave period;

said caisson including a central well open at the bottom of the casing;

means in said caisson for providing liquid storage compartments;

a plurality of production risers arranged in said central well;

a buoyant means for each riser in the upper portion of said central well for supporting and tensioning each riser, said buoyant means being adjacent the upper portion of said caisson and the water plane area;

mooring means attached to the lower portion of the caisson for anchoring said caisson to a sea bed;

and ballast means at the lower end portion of the caisson for maintaining the center of gravity of said caisson below the center of buoyancy thereof.

* * * * *